United States Patent [19]

Sedlak et al.

[11] Patent Number: 4,472,068

[45] Date of Patent: Sep. 18, 1984

[54] WATCH MOVEMENT WITH A ROTATING MINUTE DISC

[75] Inventors: Adolf Sedlak, Wurmberg; Gerhard Stotz, Niefern, both of Fed. Rep. of Germany

[73] Assignee: Timex Corporation, Waterbury, Conn.

[21] Appl. No.: 456,681

[22] Filed: Jan. 10, 1983

[30] Foreign Application Priority Data

Feb. 26, 1982 [DE] Fed. Rep. of Germany ..... 3206944

[51] Int. Cl.[3] ..... G04B 19/02

[52] U.S. Cl. ..... 368/221; 368/233; 368/234

[58] Field of Search ..... 368/221, 233, 234

[56] References Cited

U.S. PATENT DOCUMENTS 4,362,397 12/1982 Klingenberg ..... 368/234
4,376,996 3/1983 Wuthrich ..... 368/221
4,407,586 10/1983 Musy ..... 368/221

FOREIGN PATENT DOCUMENTS 1018684 1/1953 France ..... 368/234

*Primary Examiner*—Bernard Roskoski
*Attorney, Agent, or Firm*—William C. Crutcher

[57] ABSTRACT

Movement for a wrist watch, having at least one rotatable minute disc, a drive connection between the toothed disc edge and a drive pinion, being reliably and positively maintained in that the disc is mounted with clearance and capable of tilting, in that simple guide pins for the disc edge are provided on both sides of the disc in the region of the drive connection between the pinion and the disc. For example, one guide pin may be provided on each side of the minute disc. Alternatively, one pin is provided on one side of the disc and two additional guide pins lie opposite to this first pin on the other side of the disc.

4 Claims, 3 Drawing Figures

WATCH MOVEMENT WITH A ROTATING MINUTE DISC

BACKGROUND OF THE INVENTION

This invention relates to a movement for a wrist watch of the type having a large minute disc driven directly at its periphery by the rotor pinion of a stepping motor. Such a movement may be used in a quartz analog watch wherein the stepping motor is driven by an integrated circuit. The minute disc may turn a minute hand on the same sleeve or have a minute indicator painted directly on it.

This type of watch, namely a flat wrist watch, is described in laid open German patent application DE-OS No. 30 16 058. In the case of the known watch, the guide members interacting with the edge of the minute disc to maintain a reliable drive connection are designed as guide rollers to order to keep friction between the guide members and the minute disc as small as possible—in the case of the known watch two superposed minute discs are provided, of which one is transparent. It has become apparent that the results obtained in practice are not entirely satisfactory since the fact that the guide members engage on the edge of a minute disc, which is precision mounted in the customary way, will lead to a considerable strain on the bearing means and therefore to a premature wear and tear of the same. In addition, the very thin minute discs, which are used for particularly flat wrist watches, tend to become distorted and deformed to such an extent that considerable axial forces automatically occur between the guide members and the disc edge when the minute disc is precision mounted. This means that any detrimental effect of these forces cannot be compensated by the fact that the guide members are designed as guide rollers rotatable about an axis parallel to the axis of rotation of the minute disc.

Another watch of this type is known from pending U.S. application Ser. No. 258 061 filed in the name of Paul Wuthrich on Apr. 27, 1981 and assigned to the present assignee, this being also laid open in Germany as DE-OS No. 3214683A1.

Proceeding on the basis of the prior art, the object underlying the invention is to improve a watch of the type described above, such that reliable and low-loss guidance of the disc edge is guaranteed in order to maintain a positive drive connection, even when the minute disc is displaced or deformed axially to a predetermined position of its face, up to the maximum to be expected in practice.

According to the invention this object is accomplished for a watch of the type described above, in that the minute disc is mounted on its pivot pin with extra radial clearance, the decisive advantage of the solution according to the invention is that the minute disc is able to carry out certain swashplate or tilting movements—within predetermined limits, of course—due to the bearing clearance intentionally provided. When the disc is distorted or the disc edge deformed, a simple tilting movement of the entire minute disc, including its bearing sleeve, relative to the pivot pin can be brought about by the guide members, the forces required being extremely low, in order to keep the disc edge in a relatively well-defined position at the point where it is in contact with the drive pinion.

In development of the invention it has proven favorable to have the two guide members designed as guide pins and disposed adjacent to the first main face of the minute disc and to have a third guide pin circumferentially spaced between the other two guide pins and adjacent to the other main face of this disc. This construction has the advantage that, first of all, simple guide pins may be used instead of the relatively complicated guide rollers. These guide pins are formed, in an advantageous development of the invention, simply by extensions of the stepping motor drive means. In addition, this results in a range of tolerance defined by three predetermined points for altering the position of the edge of the minute disc; with a view to practical requirements this range of tolerance may be selected such that the minute disc will normally not engage with any of the guide pins. This becomes clear immediately when it is considered that the thickness of a minute disc is, for example, 0.1 mm, whereas the axial gap, which is defined by the guide members and selected as a function of the height of the drive pinion, for the path of the disc edge may be 0.4 mm and therefore four times the thickness of the disc. On the other hand, even more considerable deformations of the disc edge are not in any way critical because in this case a tilting of the entire minute disc, relative to its pivot pin, will be simply brought about without any critical forces occurring at the disc bearing means, at the guide pins or at the disc edge. This guarantees a long and trouble-free operation of the watch according to the invention with little wear and tear.

DRAWING

Additional details and advantages of the invention are explained in the following on the basis of drawings showing:

FIG. 1 A perspective plan view of a preferred embodiment of a watch according to the invention with its case removed.

FIG. 2. A partial cross section through the watch according to FIG. 1 along the line 2—2 in this Figure.

FIG. 3. An enlarged partial cross section similar to FIG. 2, showing tilting of the indication disc due to extra radial clearance.

SUMMARY OF THE INVENTION

Briefly stated, the invention is practiced by providing a movement for a wrist watch, comprising an indication disc, in particular a minute disc, rotatable about a pivot pin and having spur-gear teeth along its circumference, with an indicating element, in particular a minute hand, rotatable relative to a stationary ring of numbers or the like, with a pinion drivable by a stepping motor and meshing with the spur-gear teeth and with at least two fixed guide members in the vicinity of the pinion interacting, one on each side of the minute disc to maintain a reliable, positive drive connection between the pinion and the minute disc. The minute disc is mounted with extra radial clearance about its pivot pin with extra radial clearance to permit a tilting movement.

DESCRIPTION OF THE PREFERRED EMBODIMENT

Figure 1:
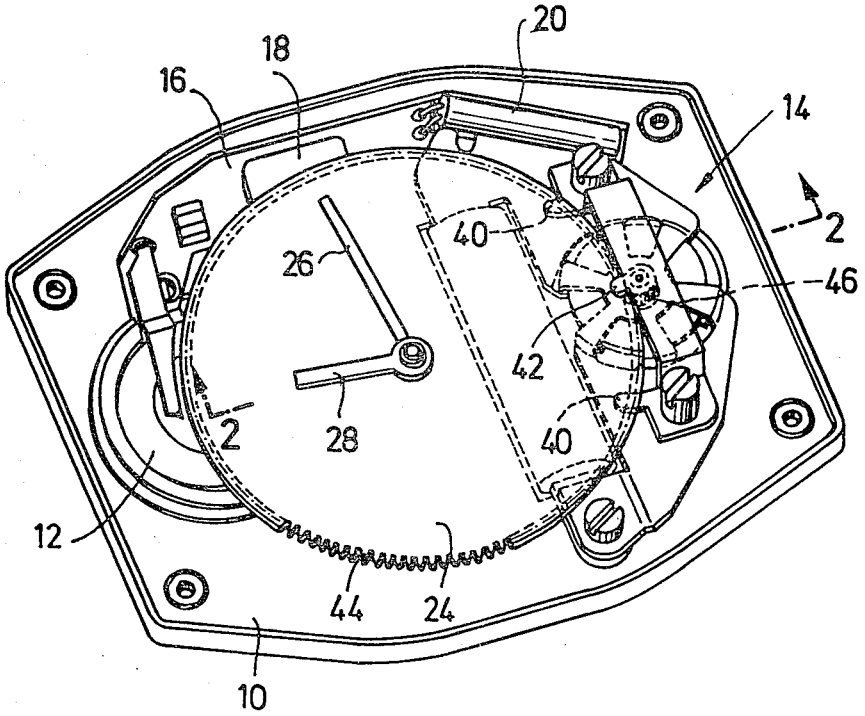
Figure 2:
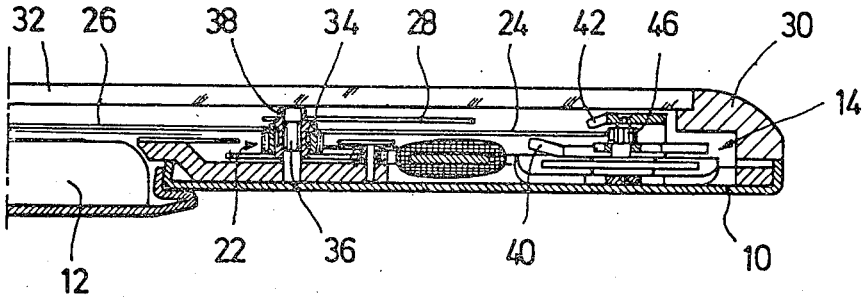

FIG. 1 shows in detail a caseback 10, on which a battery 12 and the various elements of a watch movement are mounted, i.e. stepping motor 14, a printed circuit 16 with an integrated semiconductor circuit 18 and an oscillator crystal 20 as well as a watch gear unit 22, together with a minute disc 24, a minute hand 26 and an hour hand 28. When the watch has been fully assembled all these elements are, as shown in FIG. 2, enclosed by a case or a case ring 30, in which a watch crystal 32 is held, this covering the entire arrangement according to FIG. 1. The watch crystal may be provided, on its inside or outside, with an opaque coating outside the circumference of the minute disc 24 so that the inner workings of the watch are not visible. In addition, the inside the watch crystal 32 is normally provided with a ring of numbers; the numbers may be etched into the watch glass or applied to it or may be provided on their own carrier underneath the watch crystal.

The elements described above for the watch shown in FIGS. 1 and 2 are largely conventional or known or of no particular interest within the scope of this present appliation. Two features according to the invention for the watch in question are, however, of importance, the first of these being that a bearing sleeve 34 provided in the centre of the minute disc 24 encloses, with extra radial clearance, the pivot pin 36 of the gear unit 22 (or the hour shaft 38 seated on this pin 36) said shaft carrying the hour hand 28. This added radial clearance enables a certain tilting of the minute disc 24 to take place relative to the pivot pin 36 serving as its axis of rotation.

In addition, two circumferentially spaced lower guide pins 40 are provided according to the invention along the edge of the minute disc 24, i.e., two guide pins interacting with the underside of the disc 24, as well as one upper guide pin 42 interacting with the upper side of the disc 24. The upper guide pin 42 is circumferentially spaced between the lower guide pins 40. The three guide pins 40, 42 define a gap in the axial direction, in which the edge of the minute disc 24 may float freely without any risk of the spur-gear teeth 44 along the outer circumference of the disc 24 being able to disengage from the drive pinion 46 of the drive means 14. When the edge of the disc 24 is deformed to an even greater extent and the range of tolerances defined by the guide pins 40, 42 exceeded, these guide pins 40, 42 will, according to the invention, force the minute disc 24 to tilt. This presents no problem because the bearing sleeve 34 encloses the pivot pin 36 with extra radial clearance. In this case as well, i.e. even with greater deformations of the minute disc 24 which has the minute hand 26 firmly secured to it, the drive connection between pinion 46 and spur-gear teeth 44 is reliably and positively maintained.

Figure 3:
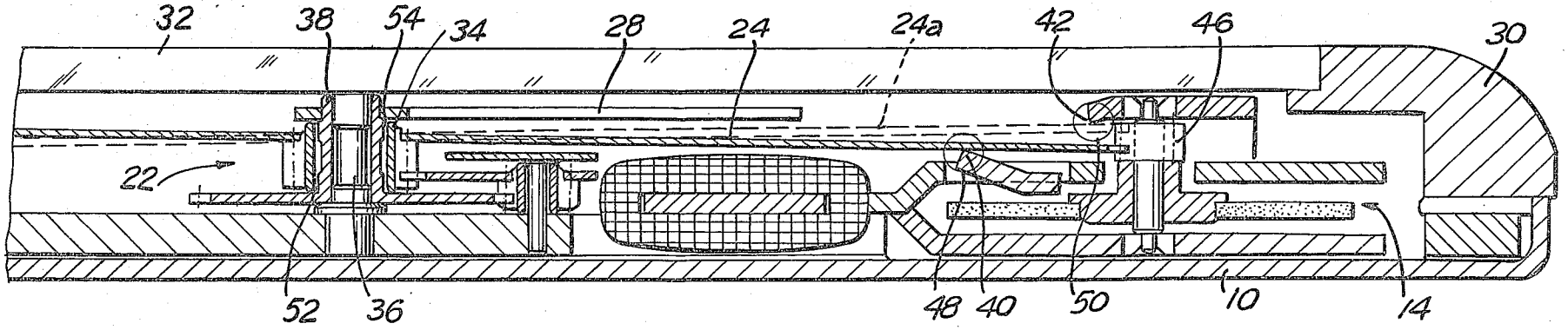

FIG. 3 is an enlarged view illustrating operation of the invention. Due to the added radial clearance between sleeve 34 and hour shaft 38, the disc 24 can tilt against the lower guide pins 40, contacting them as shown at 48. It can also tilt in the opposite direction, as shown by dashed line 24*a*, to contact the upper guide pin 42, as shown at 50. The radial clearance permitting tilting is indicated at 52, 54.

As far as the guide pins 40 and 42 are concerned, it is extremely easy and cheap to have the edge area in question of the minute disc 24 guided without difficulty in the area of the drive means, i.e. in the direct vicinity of the pinion 46, since these guide pins may simply be provided on the yoke and holding elements already available on the stepping motor 14, as is the case in the embodiment shown. In addition, the fact that the minute disc 24 is mounted with a certain clearance in order to enable the disc 24 to tilt as required will be rather cheaper, certainly not more expensive, than the precision mounting used previously. This makes it clear that the object underlying the invention may be accomplished in the way described with practically no additional costs.

Finally, it should be pointed out that the watch according to the invention can also be advantageously designed such that the two guide members are constructed as two guide pins, which are disposed opposite each other relative to the minute disc and are each adjacent to and spaced from one of the main faces of the minute disc in the vicinity of the pinion. In this case only two guide pins are therefore provided. The disc 24 can turn between them with a certain clearance and may about on them, if necessary, with one or other of its main faces, a reliable and positive drive connection between the pinion 46 and the spur-gear teeth 44 of the minute disc 24 being maintained at all times.

We claim:

1. An improved movement for a wrist watch, comprising a minute disc rotatable about a pivot pin and having spur-gear teeth along its circumference, carrying a minute hand rotatable relative to a stationary ring of numbers or the like, with a pinion driven by a stepping motor and meshing with the spur-gear teeth and with two fixed guide members interacting in the vicinity of the pinion, one guide member spaced on either side of the minute disc, to maintain a reliable, positive drive connection between the pinion and the minute disc, said minute disc being mounted on said pivot pin with extra radial clearance, whereby it may tilt to a limited degree to contact said fixed guide members.

2. Watch movement according to claim 1 wherein said one of said fixed guide members is designed as first and second circumferentially spaced guide pins disposed adjacent to a first main face of said minute disc and the other said fixed guide member is a third guide pin circumferentially spaced between the first and second guide pins and axially spaced from the other main face of said disc.

3. Watch movement according to claim 2, wherein said first and second guide pins are formed by extensions of said stepping motor.

4. Watch movement according to claim 1, wherein said two fixed guide members are designed as first and second guide pins disposed opposite each other relative to said minute disc, each guide pin being adjacent to and spaced from one of the main faces of the minute disc in the vicinity of said pinion.

* * * * *